US005199118A

United States Patent [19]

Cole et al.

[11] Patent Number: 5,199,118

[45] Date of Patent: Apr. 6, 1993

[54] HAND WASH STATION

[75] Inventors: Charles K. Cole, Glenview; Joseph A. Mitre, Bellwood, both of Ill.

[73] Assignee: World Dryer, Division of Specialty Equipment Companies, Inc., Chicago, Ill.

[21] Appl. No.: 653,273

[22] Filed: Feb. 11, 1991

[51] Int. Cl.[5] ..... A47K 1/04; E03C 1/05

[52] U.S. Cl. ..... 4/619; 4/623; 4/628

[58] Field of Search ..... 4/619, 623, 624, 628, 4/638

[56] References Cited

U.S. PATENT DOCUMENTS

| | | | |
|---|---|---|---|
| 1,765,915 | 6/1930 | Haase | 4/661 |
| 3,151,340 | 10/1964 | Teshima | 251/129.04 |
| 3,358,747 | 12/1967 | Lesher et al. | 165/12 |
| 3,505,692 | 4/1970 | Forbes | 4/623 |
| 3,556,146 | 1/1971 | Green | 137/606 |
| 3,576,277 | 4/1971 | Blackmon | 222/1 |
| 3,639,920 | 2/1972 | Griffin | 4/623 |
| 4,072,157 | 2/1978 | Wines, Jr. et al. | 134/58 R |
| 4,130,123 | 12/1978 | Wines, Jr. et al. | 134/56 R |
| 4,144,596 | 3/1979 | MacFarlane et al. | 4/626 |
| 4,145,769 | 3/1979 | MacFarlane et al. | 4/626 |
| 4,219,367 | 8/1980 | Cary, Jr. et al. | 134/29 |
| 4,336,619 | 6/1982 | Hinkel et al. | 4/619 |
| 4,398,310 | 8/1983 | Lienhard | 4/623 |
| 4,402,095 | 9/1983 | Pepper | 4/623 |
| 4,606,085 | 8/1986 | Davies | 4/623 |
| 4,638,496 | 1/1987 | Jensen | 375/104 |
| 4,670,010 | 6/1987 | Dragone | 604/289 |
| 4,735,357 | 4/1988 | Gregory et al. | 236/93 R |
| 4,742,836 | 5/1988 | Buehler | 134/182 |
| 4,765,003 | 8/1988 | Chang | 4/624 |
| 4,767,922 | 8/1988 | Stauffer | 250/221 |
| 4,769,863 | 9/1988 | Tegg et al. | 4/625 |
| 4,872,485 | 10/1989 | Laverty, Jr. | 137/629.11 |
| 4,884,725 | 12/1989 | Ahad et al. | 222/639 |
| 4,889,315 | 12/1989 | Imanaga | 4/623 |
| 4,941,219 | 7/1990 | Van Marcke | 4/623 |
| 4,942,631 | 7/1990 | Rosa | 4/623 |
| 5,031,258 | 7/1991 | Shaw | 4/623 |

OTHER PUBLICATIONS

Hands-Free Hand Sanitizing Stations brochure by Bi--Line Handi-Wash brochure by Charles Parker Company.

The Best Solution for Washing Hands brochure by Shulthess.

*Primary Examiner*—Henry J. Recla
*Assistant Examiner*—David J. Walczak
*Attorney, Agent, or Firm*—Lee, Mann, Smith, McWilliams, Sweeney & Ohlson

[57] ABSTRACT

A hand sanitizing wash station including a sink, a soap dispenser located above the sink for supplying soap, a water dispensing faucet located above the sink operated by a solenoid valve, a hot-air dryer located above the sink for supplying hot-air, a first infrared sensor for detecting the proximity of a user, the first sensor being operatively connected to the soap dispenser and the solenoid valve to activate the soap dispenser and the solenoid valve upon detecting the presence of a user, and a second infrared sensor for detecting the presence of a user, the second sensor being operatively connected to the solenoid valve and the hot-air dryer such that the second sensor will deactivate the solenoid valve and will activate the hot-air dryer.

14 Claims, 4 Drawing Sheets

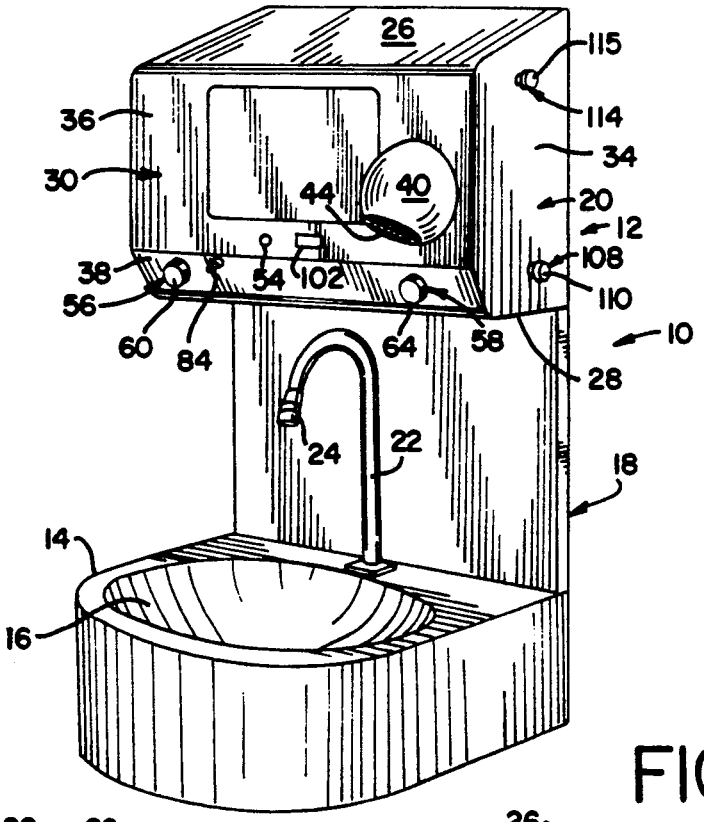
FIG. 1
FIG. 2
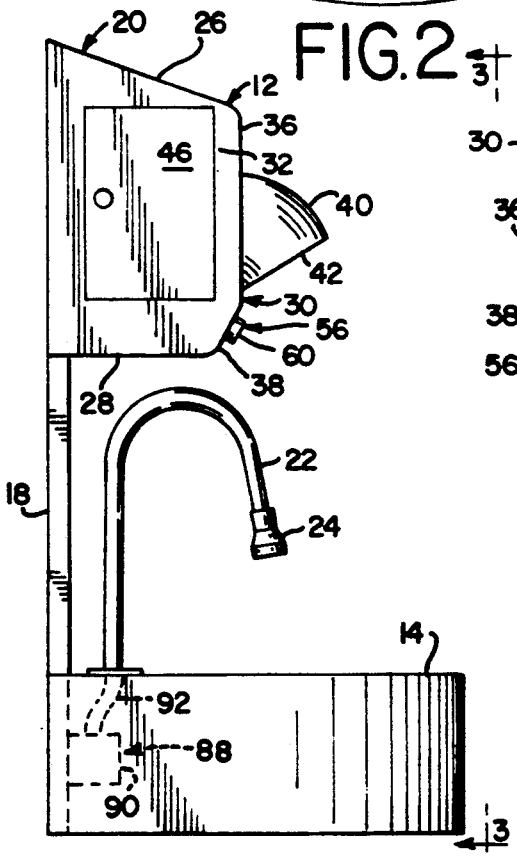
FIG. 3
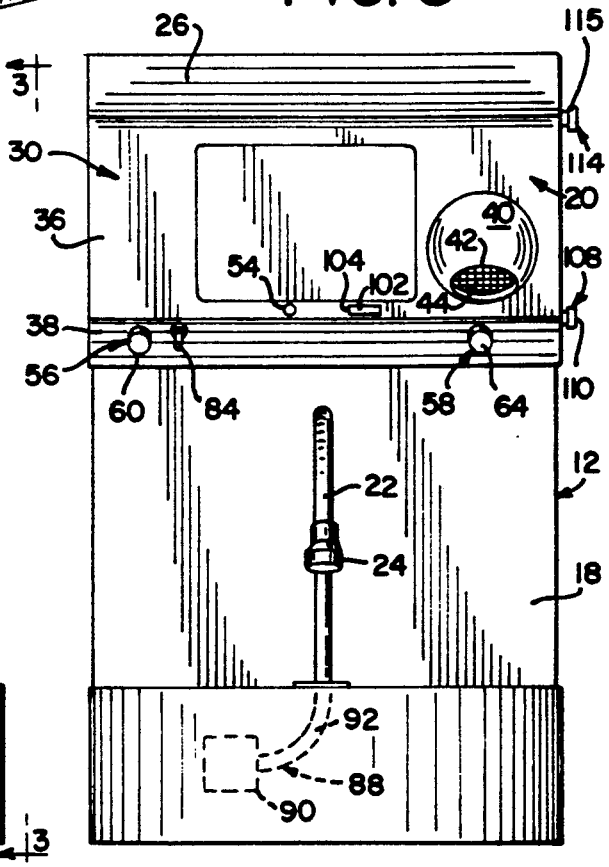

HAND WASH STATION

BACKGROUND OF THE INVENTION

The present invention relates to hand sanitizing wash stations, particularly to wash stations suitable for use in commercial environments and especially for use in locations where food is handled such as in restaurant kitchens, fast food franchises and food processing plants. Food handlers are required by federal, state and local government agencies to maintain their hands in a sanitized condition. Food handlers are required to wash their hands after handling money, after smoking or eating, after performing any cleaning job, after using the bathroom, after any breaks, before coming on duty and in general frequently during the day. Standard sinks with manually operated water faucets and manually operated soap dispensers have been found unsatisfactory as the sinks and soap dispensers and their associated parts become unsanitary through continual contact with users. For example, when a user turns a faucet on or off or pumps soap, the user not only deposits germs but picks up germs as well.

As state and local government agencies are involved in regulating the sanitation requirements for food handlers, the regulations vary from city to city. The length of time users must spend in sanitizing or washing their hands is generally regulated and is often referred to as the "legal wash time". A persistent problem of employers of food handlers is ensuring that their employees meet the hand washing regulations and the legal wash times. Employees may fail to apply soap to their hands or they may fail to wash their hands for the required legal wash time. Automatic dispersal of soap and water helps to eliminate these problems.

Due to the varying regulations on hand washing, it is desirable to be able to vary the length of time for which the water is dispensed. While it is desirable to have the water dispensed for a minimum length of time to conserve water, in many cases where the dispensing of water is timed, the water is shut off before users will have had sufficient time to thoroughly finish cleaning and rinsing their hands. If the water is automatically set to dispense for a substantially longer period of time than the minimum legal wash time, many users will complete washing their hands well before the water is shut off, thereby wasting water. It has therefore been found desirable to have water automatically dispensed for a period of time which is responsive to the individual needs of users such that a user may shut off the water at any time after the legal wash time has been met, and to automatically shut off the water after a sufficiently long length of time if a user should fail to turn off the water. To help insure that users will turn off the water it has been found desirable to have the water turned off automatically when a user activates a hot-air dryer for drying his or her hands.

PRIOR ART WASH STATIONS

U.S. Pat. No. 3,639,920 describes a device for dispensing soap and water according to a programmed sequence upon the activation of a single sensing device. U.S. Pat. No. 4,398,310 describes the use of a single sensor to initiate dispensing of soap, water and hot air according to a programmed sequence.

These prior art patents appear to be the closest prior art thus far known to the applicant.

SUMMARY OF THE INVENTION

Applicant's present invention provides an improved wash station for dispensing soap, water and hot air according to an individual user's needs while also providing for a minimum legal wash time and maximum soap, water and heated air dispensing times.

The invention provides an improved hand sanitizing wash station which includes individual means for respectively dispensing soap, water and heated drying air. First and second sensors are provided. Each sensor is respectively activated by a user placing one or both of his or her hands in proximity to, but not in contact with, the respective sensors. Upon the user placing his or her hands in the proximity of the first sensor, the first sensor will activate the soap and water dispensing means. Removal of the user's hands from the proximity of the first sensor will deactivate the soap dispensing means, however the water dispensing means will continue to operate. When the user places his or her hands in the proximity of the second sensor, the second sensor will deactivate the water dispensing means and will also activate the dryer means to dispense heated air. Upon removal of the user's hands from the proximity of the second sensor, the dryer means will be deactivated.

Each of the soap, water and hot air dispensing means may be selectively programmed to have a maximum activation time after which each will automatically deactivate. The water dispensing means may be programmed to delay its activation for a period of time after the soap dispensing means has been activated. The water dispensing means may also be programmed such that it will remain activated for a minimum length of time, during which the second sensor is unable to deactivate the water dispensing means to insure that legal wash times are met. The wash station automatically dispenses soap, water and heated drying air without the user being required to touch any part of the wash station. Each of the dispensing means is automatically operated while remaining adaptable to meet an individual user's needs.

BRIEF DESCRIPTION OF THE DRAWINGS

FIG. 1 is a perspective view of the hand wash station of the present invention.

FIG. 2 is a side elevational view of the hand wash station.

FIG. 3 is a front elevational view of the hand wash station.

DETAILED DESCRIPTION OF THE INVENTION

Figure 4:
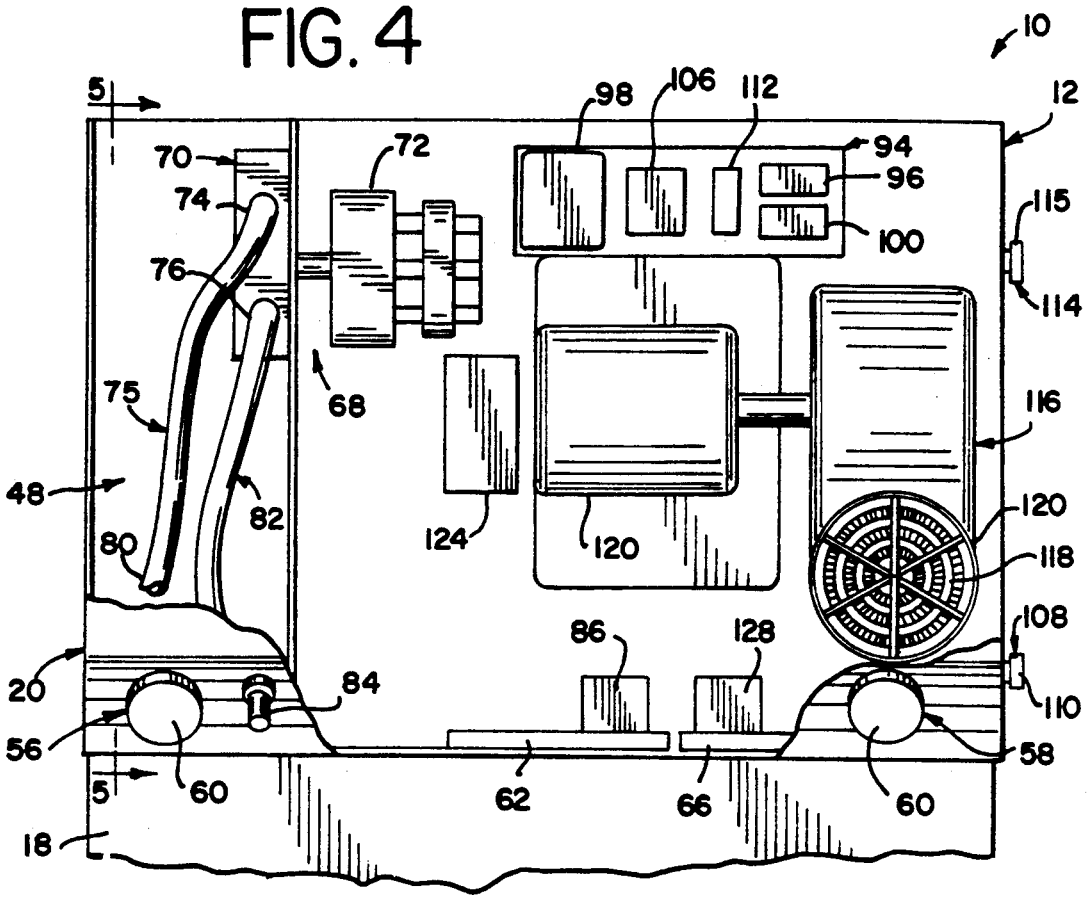
FIG. 4 is a partial front elevational view on an enlarged scale having a portion of the cover removed to show the internal components of the hand wash station.

The wash station 10 as best shown in FIGS. 1-3 includes a housing 12. The housing 12 includes a sink 14 having an oval-shaped basin 16, a back panel 18 and an upper control cover 20. The cover 20, the back panel 18 and the sink 14 are preferably made of stainless steel. The back panel 18 extends substantially the entire height of the wash station 10. The sink 14 is attached to the lower portion of the back panel 18. A goose neck spout 22 is attached to the sink 14 adjacent to and spaced apart from the back panel 18 such that the spout 22 will dispense water into the basin 16. The spout 22 includes a laminar flow head 24 for dispersing the dispensed water with a minimum of splash. The basin 16 also includes a drain which is not shown. Various other configurations of the sink 14, the basin 16 and the spout 22 may be used as desired. One such alternate configuration is for handicapped users which includes a rectangular sink 14 and a retangular basin 16 (not shown).

The cover 20 is removably attached to the upper portion of the back panel 18. The cover 20 includes a top panel 26, a bottom panel 28, a face panel 30, a left side panel 32, and a right side panel 34. The face panel 30 includes an upper vertical section 36 and a lower inclined section 38. The vertical section 36 of the face panel 30 includes an aperture (not shown) over which an air blower nozzle 40 is placed. The nozzle 40 includes an aperture 42 which is enclosed by a wire mesh screen 44. The aperture 42 of the nozzle 40 is directed downwardly in the general direction of the basin 16. The bottom panel 28 includes vents (not shown) for supplying air to the interior of the cover 20. The left side panel 32 includes a door 46 which permits access into the interior of the cover 20.

Figure 5:
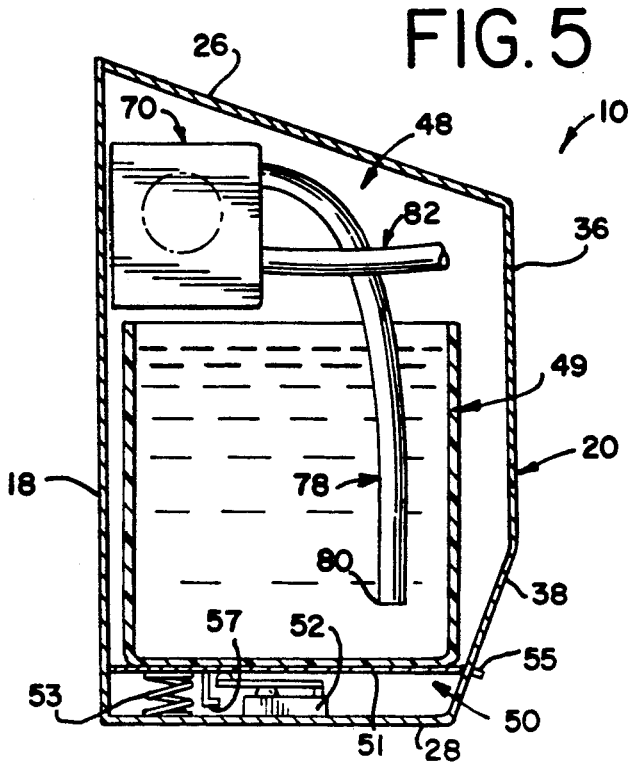
FIG. 5 is a partial cross sectional view taken along lines 5—5 of FIG. 4.

As shown in FIGS. 4 and 5, the wash station 10 includes a soap isolation chamber 48 which is adapted to receive a container of soap 49 and to contain any soap spillage which may occur within the isolation chamber 48. The soap container 49 may be removed and replaced through the door 46 in the left side panel 32 of the cover 20. The isolation chamber 48 includes a scale 50 upon which the container of soap 49 is placed. The scale 50 includes a plate 51 which is resiliently supported by a spring 53 at one end and which is pivotally supported by a pair of tangs 55 (only one shown) at the other end as best shown in FIG. 5. A rod 57 extends downwardly from the plate 51 adjacent a switch 52. A second rod (not shown) extends downwardly from the plate 51 through the center of the spring 53 to retain the spring 53 in its proper position. As soap is withdrawn from the soap container 49, the spring 53 will bias the plate 51 in an upward direction thereby pivoting the plate 51 about the tangs 55. The switch 52 is activated by the rod 57 when the volume of soap remaining within the soap container 49 reaches a predetermined low level and the plate 51 and the rod 57 have moved sufficiently upwardly to activate the switch 52. A low soap indicator light 54 is attached to the vertical section 36 of the face panel 30 and is activated by the switch 52 to give indication to users or maintenance personnel when the wash station 10 is low on soap. A preferred switch 52 is the Model AT-Y as manufactured by CK/Unimax in Wallingford, Conn.

The wash station 10 includes a first sensor 56 and a second sensor 58. The first sensor 56 includes a transmitter/receiver 60 which is electrically connected to a sensor control 62. The second sensor 58 includes a transmitter/receiver 64 which is electrically connected to a sensor control 66. The transmitter/receiver 60 of the first sensor 56 is located at the left side of the inclined section 38 of the face panel 30 near the left side panel 32. The transmitter/receiver 64 of the second sensor 58 is located at the right side of the inclined section 38 of the face panel 30 near the right side panel 34 and directly under the nozzle 40. The sensors 56 and 58 are spaced sufficiently far apart such that when one sensor is activated by a user, the user will not inadvertently activate the other sensor. The sensors 56 and 58 are intended to be respectively activated by the user placing at least one of his or her hands in the proximity detection range of a respective sensor 56 or 58. The sensors 56 and 58 are preferably infrared sensors, however ultrasonic and other types of sensors may also be used. A preferred sensor 56 is the Model K8103 as manufactured by Instrumentation and Control Systems, Inc. in Addison, Ill. or the Model 400-115M as manufactured by Thermocet B.V., Hengelo (GLD), Holland. A preferred sensor 58 is the Model K8119 as manufactured by Instrumentation and Control Systems, Inc. or the Model 400-115 as manufactured by Thermocet B.V.

The wash station 10 includes a soap dispenser 68 which includes a pump 70 and a motor 72 for driving the pump 70. The motor 72 is electrically connected to and activated by the first sensor 56. The pump 70 includes an inlet 74 and an outlet 76. A first flexible tube 78 is attached to the inlet 74 of the pump 70. The first flexible tube 78 includes a free end 80 which may be inserted into the soap container 49. A second flexible tube 82 is attached at one end to the outlet 76 of the pump 70 and to a soap dispensing nozzle 84 at the other end. The soap dispensing nozzle 84 is located on the inclined section 38 of the face panel 30 adjacent to the transmitter/receiver 60 of the first sensor 56. The nozzle 84 is located above the basin 16 so that any soap which is dispensed, and which may miss the user's hands, will fall into the basin 16. A preferred nozzle 84 is a duck bill valve which will prevent soap from dripping from the nozzle 84 when soap is not intended to be dispensed. Operation of the motor 72 will cause the pump 70 to draw soap from the soap container 49 through the tube 78. The pump 70 will then discharge soap through the tube 82 and to the user through the nozzle 84. The pump 70 will preferably deliver approximately 1.2 cubic inches of soap per minute. A preferred soap pump 70 is a peristaltic pump model 908-058250 as manufactured by Anko Products in Bradenton, Fla. A soap pulse timer 86 is integrally included in the first sensor 56. The preferred sensors 56, Model K8103 as manufactured by Instrumentation and Control Systems, Inc. and the Model 400-115M as manufactured by Thermocet B.V., both include an integrated soap pulse timer 86.

The wash station 10 also includes a water dispenser 88 (FIGS. 2 and 3). The water dispenser 88 includes a solenoid valve 90 which is attached to the back panel 18 within the sink 14 as best shown in FIGS. 2 and 3. The solenoid valve 90 is in fluid communication with the spout 22 through a flexible tube 92. The solenoid valve 90 may be of many different types, however a preferred solenoid valve 90 is the Model HV2568061 as manufactured by Automatic Switch Co. in Florham Park, N.J. A desired mixture of hot and cold water from an exterior source is supplied under pressure to the solenoid valve 90. Preferably approximately 1.25 gallons of water per minute is dispensed from the spout 22.

The water dispenser 88 also includes a control module 94 (FIG. 4). The control module 94 includes a latching relay 96 which is electrically connected between the first sensor 56 and the solenoid valve 90. A preferred latching relay 96 is Model MY2K as manufactured by Omron Electronics Inc. in Schaumburg, Ill. The control module 94 also includes a water override timer 98 which is electrically connected between the water latching relay 96 and the solenoid valve 90. A preferred override timer 98 is the Model 4300 solid state interval timer as manufactured by Artisan Controls in Parsippany, N.J. The control module 94 preferably includes a legal wash timer 100 which is electrically connected between the latching relay 96 and a wash cycle counter 102 (FIGS. 1 and 3). A preferred legal wash timer 100 is the Model 438 USA (Universal Switch Adjustable) timer as manufactured by Artisan Controls in Parsippany, N.J. The legal wash cycle counter 102 is attached to the vertical section 36 of the face panel 30 and is located in the interior of the cover 20. The counter 102 includes a digital display which is visible to a user or others through an aperture 104 in the vertical section 36 of the face panel 30. A preferred counter 102 is the Model GNR-024AN as manufactured by SPC Technology in Chicago, Ill. The legal wash timer 100 may be adjusted to activate the wash cycle counter 102 after the latching relay 96 has been latched on for any desired period of time.

The control module 94 also preferably includes a sensor disabling relay 106 (FIG. 4) which is activated by a sensor disabling switch 108 (FIGS. 1, 3 and 4). A preferred disabling relay 106 is the Model G4B-112T1-FD-C-US-RP as manufactured by Omron Electronics, Inc. in Schaumburg, Ill. The sensor disable switch 108 is mounted on the right side panel 34 such that it may be operated from the exterior of the wash station 10 for disabling and enabling the sensors 56 and 58. The sensor disable switch 108 includes an indicator light 110 which is operative to indicate to users and maintenance personnel when the sensors 56 and 58 are disabled. A preferred sensor disable switch 108 is the Model TH 251-911 as manufactured by CK/Unimax in Wallingford, Conn. The control module 94 also preferably includes a water only relay 112 (FIG. 4) which is electrically connected to the solenoid valve 90 and is activated by a water only switch 114. The switch 114 is mounted to the right side panel 34 such that the switch 114 is manually operable between on and off positions from the exterior of the wash station 10 to provide manual dispensing of water from the spout 22. The switch 114 includes an indicator light 115. A preferred water only switch 114 is the Model TH 251-911 as manufactured by CK/Unimax. A preferred relay 112 is the Model G2R as manufactured by Omron Electronics, Inc.

The wash station 10 also includes a hot-air dryer 116 (FIG. 4) which includes a heating coil 118. Hot air is dispensed from the dryer 116 by a dryer motor 120. The dryer 116 includes an exhaust port 122 which is located adjacent to the nozzle 40 on the face panel 30 such that hot air produced by the dryer 116 will be dispensed through the aperture 42 in the nozzle 40. The dryer 116 will preferably increase the temperature of the dispensed air to 65° F. above ambient temperatures (140° F. at 75° F. ambient temperature). The dryer 116 will also preferably deliver approximately 130 cubic feet of heated air per minute at approximately 5500 lineal feet per minute as the heated air is dispensed from the nozzle 40. A preferred dryer 116 is the Model "A" dryer as manufactured by World Dryer Corporation in Berkeley, Ill., the assignee of this invention. A dryer override timer 128 is integrally included in the second sensor 58. The preferred sensors 58, Model K8119 as manufactured by Instrumentation and Control Systems, Inc. and Model 400-115 as manufactured by Thermocet B.V., both include an integrated dryer override timer 128.

The wash station 10 also includes a step down transformer 124 for reducing 120 volts A.C. to 24 volts A.C. All of the electrical controls which are accessible to a user, such as the light 54, the counter 102, and the switches 114 and 108, operate on the low voltage of 24 volts.

Figures 6, 7:
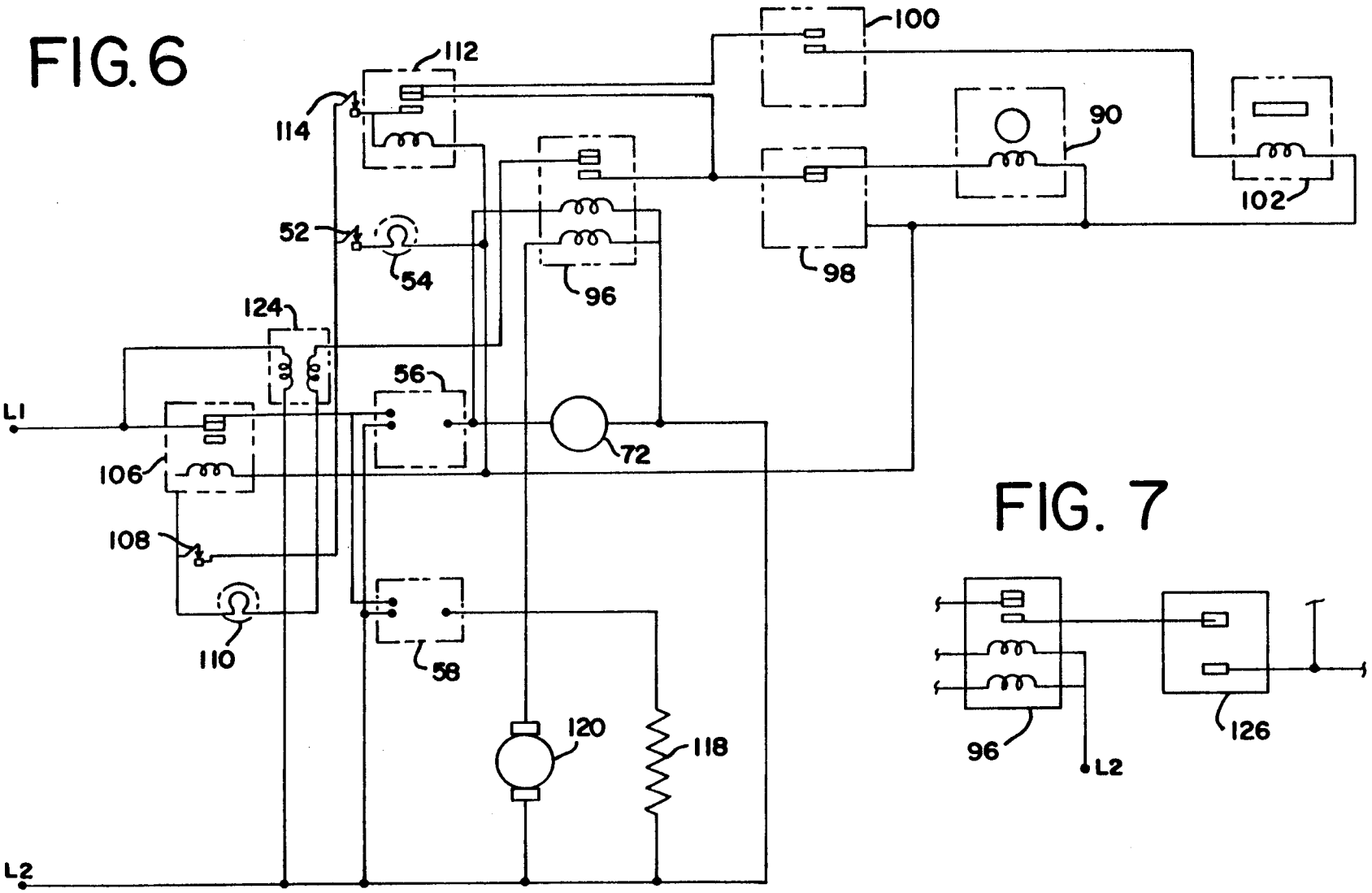
FIG. 6 is an electrical circuit diagram showing the circuitry for controlling the operation of the wash station.
FIG. 7 is a partial electrical circuit diagram showing the circuitry for controlling the operation of the water delay timer.

FIG. 6 illustrates the electrical components and interconnecting circuitry of the wash station 10. As illustrated in FIG. 6 considered in conjunction with FIGS. 1–4, to initiate the operation of the wash station 10, a user will place at least one of his or her hands underneath the soap dispensing nozzle 84 whereupon the transmitter/receiver 60 of the first sensor 56 will detect the proximity of the user. The first sensor 56 will then activate the soap pump motor 72 such that the soap pump 70 will dispense soap from the nozzle 84. Soap will continue to be pumped from the soap dispensing system 68 until the user removes his hands from the proximity detection range of the first sensor 56 or until the soap pulse timer 86 deactivates the soap pump motor 72 after the soap pump motor 72 has operated for a predetermined period of time, whichever occurs first. The soap pulse timer 86 is adjustable to deactivate the soap dispenser 68 at various different times as desired. When the amount of soap remaining in the soap container falls below a predetermined level, the scale 50 will detect such a condition and will activate the switch 52 and the low soap indicator light 54.

When the first sensor 56 senses the proximity of a user, the first sensor 56, in addition to activating the soap dispensing system 68, will also activate the water dispensing system 88 by activating, or latching on, the latching relay 96 which in turn activates the solenoid valve 90 to allow water to flow through the flexible tubing 92 and out the spout 22 into the basin 16. The latching relay 96 will continue to activate the solenoid valve 90 even after the user removes his hands from the proximity of the first sensor 56. The activation, or latching on, of the latching relay 96 will also activate the water override timer 98. After the latching relay 96 has activated the solenoid valve 90 for a predetermined period of time, the water override timer 98 will deactivate the solenoid valve 90 thereby shutting off the flow of water to the spout 22. The water override timer 98 may additionally be adjustable to deactivate the solenoid valve 90 at various different times as desired. When the latching relay 96 is latched on, the legal wash timer 100 will also be activated. Once the latching relay 96 has been latched on for a predetermined period of time as determined by the legal wash timer 100, the legal wash timer 100 will activate the wash cycle counter 102 to indicate that an additional legal wash cycle has been completed. The users may thus determine when they have completed a legal wash cycle by noting when the wash cycle counter 102 advances to the next displayed number. The legal wash timer 100 may be adjusted to activate the counter 102 at various different times as desired.

The wash station 10 may additionally include a water delay timer 126 as shown in FIG. 7 which will delay activation of the solenoid valve 90 by the sensor 56 for a predetermined period of time after the water latching relay 96 has been latched on. A preferred water delay timer 126 is Model 438USA as manufactured by Artisan Controls. A preferable delay period is in the range of five to twenty seconds. This delay will provide time for the user to apply the dispensed soap to his hands before water is dispensed from the spout 22.

After the user has washed and rinsed his or her hands for a period of time that is satisfactory to the user, the user may then place his or her hands in front of the aperture 42 of the nozzle 40, whereupon the transmitter/receiver 64 of the second sensor 58 will detect the proximity of the user. Upon detecting the proximity of a user, the second sensor 58 will activate the heating coil 118 and the dryer motor 120 so that hot air is dispensed by the dryer 116 from the aperture 42 thereby enabling the user to dry his or her hands. Upon sensing the proximity of a user, the second sensor 58 will additionally deactivate, or latch off, the water latching relay 96 which in turn will deactivate the solenoid valve 90 such that water will no longer be dispensed from the spout 22. This eliminates wasting of water while the user is no longer involved in washing his or her hands. If the user should fail to activate the second sensor 58 after the solenoid valve 90 has been activated, the water override timer 98 will deactivate the solenoid valve 90 after the latching relay 96 has been latched on for a predetermined period of time such as one minute.

The dryer 116 will continue to operate only as long as the user remains within the proximity range of the second sensor 58 and the user thereby continues to activate the second sensor 58. Operation of the dryer 116 will additionally activate the dryer override timer 128. Should a piece of tape, gum or other object be placed over the second sensor 58 so as to continually activate the second sensor 58, the dryer override timer 128 will deactivate the dryer 116 after the dryer 116 has operated for a predetermined period of time such as 80 seconds. The dryer override timer 128 may also be adjustable to deactivate the dryer 116 at various different times as desired. Should a piece of tape, gum or other object be placed over the first sensor 56, the soap pulse timer 85 will similarly deactivate the soap dispensing system 68 after a predetermined period of time and the water override timer 98 will deactivate the solenoid valve 90 after a predetermined period of time.

Figure 8:
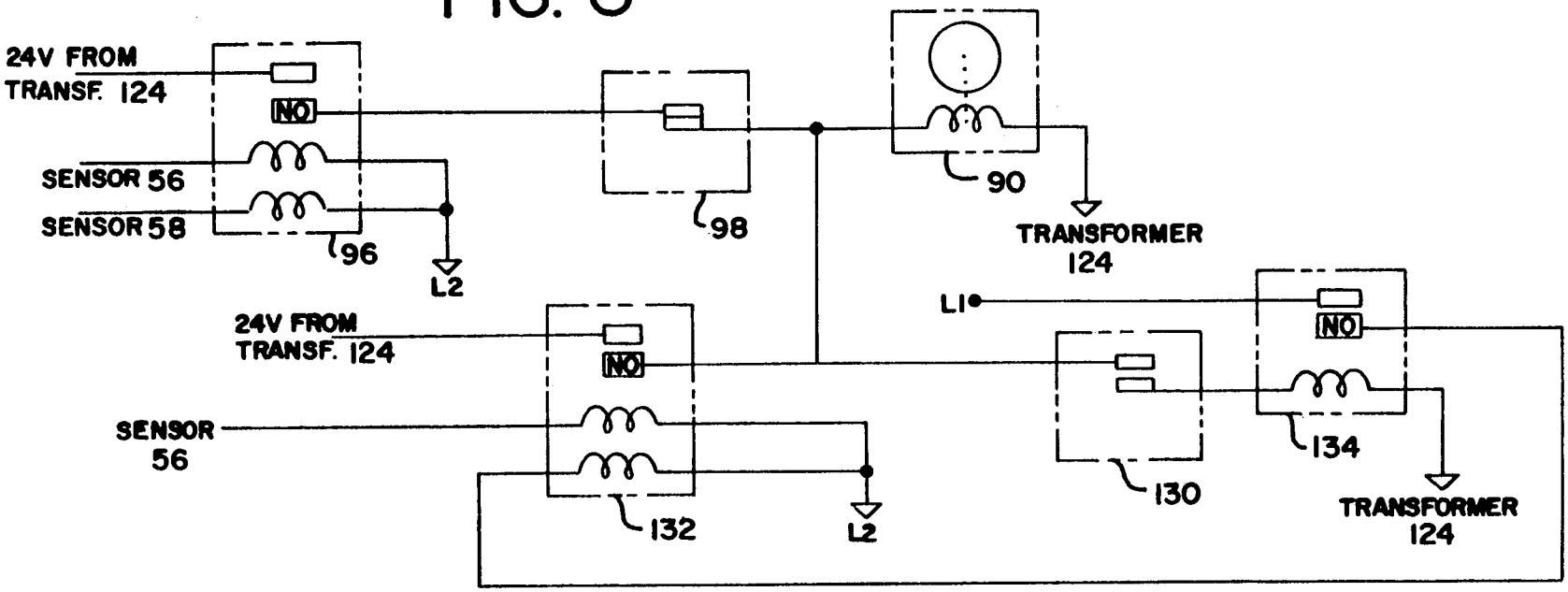
FIG. 8 is a partial electrical circuit showing the circuitry for controlling the operation of the minimum water on timer.

The wash station 10 may additionally include a minimum water on timer 130, a minimum water on latching relay 132 and an unlatching control relay 134 as shown in FIG. 8. A preferred timer 130 is the Model 438USA as manufactured by Artisan Controls. A preferred latching relay 132 is the Model MY2K as manufactured by Omron Electronics, Inc. A preferred unlatching control relay 134 is the Model G2R as manufactured by Omron Electronics, Inc. When the first sensor 56 is activated by a user, the first sensor 56 will latch on both the latching relay 96 and the latching relay 132. The solenoid valve 90 will be activated by both latching relays 90 and 132. The latching on of the latching relay 132 will activate the minimum water on timer 130. After the minimum water on timer 130 has been activated for a predetermined period of time, the timer 130 will activate the unlatching control relay 134 which will unlatch the latching relay 132. If the user has unlatched the latching relay 96 by the activation of the second sensor 58 prior to the time when the latching relay 132 is unlatched by the timer 130, the solenoid valve 90 will remain activated until the latching relay 132 is unlatched. Thus a user cannot deactivate the solenoid valve 90 until the solenoid valve 90 has been activated for a minimum predetermined period of time. The minimum water on timer 130 and the latching relay 132 will keep the solenoid valve 90 activated for a predetermined period of time even if the second sensor 58 is activated in an attempt to deactivate the solenoid valve 90. If the latching relay 132 is unlatched before the latching relay 96 is unlatched, the solenoid valve 90 will continue to be activated until the second sensor 58 is activated to unlatch the latching relay 96 or until the water override timer 98 deactivates the solenoid valve 90. The minimum water on timer 130 may be adjustable to allow the latching relay 132 to be latched on for various different times as desired.

When only water is desired to be dispensed from the spout 22, the user may activate the water only switch 114 to activate the water only relay 112 which in turn will activate the solenoid valve 90 to dispense water from the spout 22. When the water only switch 114 is returned to its off position, the water only relay 112 will deactivate the solenoid valve 90 to stop the dispensing of water. The activation of the water only relay 112 will also activate the water override timer 98 so that if the switch 114 is not returned to the off position, the water override timer 98 will deactivate the solenoid valve 90 after a predetermined period of operation. Activation of the switch 114 and the water only relay 112 will not activate the legal wash timer 100 and will not affect the wash cycle counter 102.

When the wash station 10 is to be cleaned or other maintenance performed, it is desirable to disable the sensors 56 and 58 so that they are not inadvertently activated. A user or other person may manually activate the sensor disable switch 108. The switch 108 will activate the sensor disabling relay 106 which will cut off the power to the sensors 56 and 58 thereby disabling the sensors. Activation of the disabling switch 108 will also activate an indicator light 110 to positively indicate that the sensors 56 and 58 have been disabled. Deactivation of the switch 108 will activate the disabling relay 106 to restore power to the sensors 56 and 58 thereby making them operational and the sensor disable indicator light 110 will be deactivated.

It is contemplated that the soap pulse timer 86, the water latching relay 96, the water override timer 98, the legal wash timer 100, the disabling relay 106, the water only relay 112, the minimum water on timer 130, the latching relay 132 and the unlatching relay 134 may be replaced by a printed circuit board controller (not shown).

Figure 9:
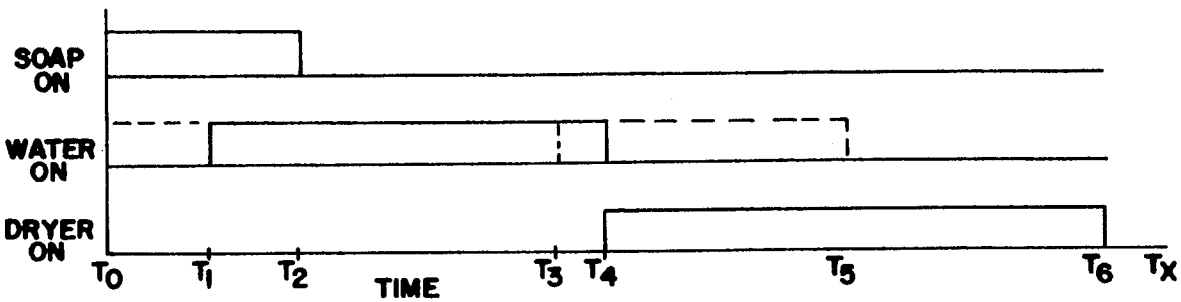
FIG. 9 is a diagram illustrating the control logic timing of the hand wash station.

The timing logic diagram of FIG. 9 illustrates the interrelationship between the operation of the soap dispenser 68, the water dispenser 88 and the dryer 116. As long as a user continues to activate the sensor 56, the soap dispenser 68 will be activated until the soap pulse timer 86 deactivates the soap dispenser 68 at time $T_2$. The soap dispenser 68 operating period, between $T_0$ and $T_2$, is preferably adjustable between 0 and 10 seconds. When a water delay timer 126 is utilized, the water dispenser 88 will be activated at time $T_1$. The period of time between $T_0$ and $T_1$ is preferably adjustable from 5 to 20 seconds. When the minimum water on timer 130 is utilized, the latching relay 132 cannot be latched off until time $T_3$. The period of time between the latching on of the relay 132 and time $T_3$ is preferably adjustable from 5 to 30 seconds. The maximum period of time which the water dispenser 88 may be activated is time $T_5$, which is preferably 60 seconds, but may be adjusted as desired. Activation of the second sensor 58 will activate the dryer 116 at time $T_4$ and will also deactivate the water dispenser 88 at time $T_4$. The maximum period of time the dryer 116 may be activated is time $T_6$, which is preferably 80 seconds from time $T_4$, but may be adjusted as desired.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A sanitizing device comprising a housing including means for dispensing soap;

means for dispensing water;

first sensor means for detecting the proximity of a user, said first sensor means being operatively connected to said soap dispensing means and to said water dispensing means such that upon sensing the proximity of a user said first sensor means activates said soap dispensing means and activates said water dispensing means;

dryer means for dispensing heated air; and second sensor means for detecting the proximity of a user, said second sensor means being operatively connected to said dryer means such that upon sensing the proximity of a user said second sensor means activates said dryer means and wherein said second sensor means is additionally operatively connected to said water dispensing means such that upon sensing the proximity of a user said second sensor means deactivates said water dispensing means.

2. The sanitizing device of claim 1 additionally including means operatively connected to said first sensor and to said water dispensing means for delaying the deactivation of said water dispensing means by said second sensor means until said water dispensing means has been operative for a minimum predetermined length of time.

3. The sanitizing device of claim 2 wherein said delay means is adjustable to provide various minimum time periods of operation of said water dispensing means as desired.

4. The sanitizing device of claim 1 additionally including means operatively connected to said first sensor means and to said water dispensing means for deactivating said water dispensing means after said water dispensing means has been operative for a predetermined length of time.

5. The sanitizing device of claim 4 wherein said deactivation means is adjustable to deactivate said water dispensing means after said water dispensing means has been operative for any desired length of time.

6. The sanitizing device of claim 1 additionally including means operatively connected to said first sensor means and to said water dispensing means for delaying the activation of said water dispensing means for a predetermined length of time after said first sensing means has activated said soap dispensing means.

7. The sanitizing device of claim 6 wherein said delay means is adjustable to provide various periods of delay as desired between the activation of said soap dispensing means and the activation of said water dispensing means.

8. The sanitizing device of claim 1 additionally including means operatively connected to said first sensor means and to said soap dispenser means for deactivating said soap dispenser means after said soap dispenser means has been operative for a predetermined length of time.

9. The sanitizing device of claim 8 wherein said deactivation means is adjustable to deactivate said soap dispenser means after said soap dispenser means has been operative for any desired length of time.

10. The sanitizing device of claim 1 additionally including means operatively connected to said second sensor means and to said dryer means for deactivating said dryer means after said dryer means has been operative for a predetermined length of time.

11. The sanitizing device of claim 10 wherein said deactivation means is adjustable to deactivate said dryer means after said dryer means has been operative any desired length of time.

12. The sanitizing device of claim 1 additionally including means for disabling said first and second sensors.

13. The sanitizing device of claim 1 additionally including means for providing manual activation and deactivation of said water dispensing means.

14. A method of dispensing soap, water and heated air for sanitizing hands comprising the steps of:

connecting a first proximity sensor to a soap pump motor;

connecting said first proximity sensor to a solenoid valve;

activating said soap pump motor and said solenoid valve by placing at least one hand in the proximity detection range of said first proximity sensor;

connecting a second proximity sensor to a dryer and to said solenoid valve; and activating said dryer and deactivating said solenoid valve by placing at least one hand in the proximity detection range of said second proximity sensor.

* * * * *